US008350138B2

(12) United States Patent
Schmader

(10) Patent No.: US 8,350,138 B2
(45) Date of Patent: Jan. 8, 2013

(54) RATTLE SYSTEM FOR CAJON

(76) Inventor: Nicholas M. Schmader, Albuquerque, NM (US)

( * ) Notice: Subject to any disclaimer, the term of this patent is extended or adjusted under 35 U.S.C. 154(b) by 335 days.

(21) Appl. No.: 12/661,913

(22) Filed: Mar. 26, 2010

(65) Prior Publication Data

US 2012/0073420 A1 Mar. 29, 2012

Related U.S. Application Data

(60) Provisional application No. 61/211,338, filed on Mar. 30, 2009.

(51) Int. Cl.
*G10D 13/02* (2006.01)

(52) U.S. Cl. ..... 84/411 R

(58) Field of Classification Search ..... 84/411 R, 84/421, 402–410

See application file for complete search history.

(56) References Cited

U.S. PATENT DOCUMENTS

| | | | | |
|---|---|---|---|---|
| 4,179,973 | A * | 12/1979 | White | 84/402 |
| 6,365,810 | B1 * | 4/2002 | Enhoffer et al. | 84/402 |
| 2009/0158914 | A1 * | 6/2009 | Boettger | 84/421 |

* cited by examiner

*Primary Examiner* — Kimberly Lockett

(57) ABSTRACT

Wherein a cajon incorporating a rattle system is attached to the front panel of the cajon, provision is made that the rattle system give off a more desirable musical rattle or buzzing sound then any prior art as the cajon is played by a percussionist. With the rattle system mounted and in place, it's hollow body allows free moving glass beads to be set into motion creating a much desired audible response upon impact of the front face of the cajon. Further, this audible response is a controlled or gated response due to the way the glass beads travel up an incline within the rattle assembly and then return to their relative starting positions leaving no lingering rattle or buzzing sound.

17 Claims, 7 Drawing Sheets

RATTLE SYSTEM FOR CAJON

CROSS-RELATED TO RELATED APPLICATIONS

This application claims the benefit of U.S. Provisional Patent Application Ser. No. [61/211,338], filed [Mar. 30, 2009], and the subject matter thereof is incorporated herein by reference thereto.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

TECHNICAL FIELD

The present invention relates generally to a cajon, and more specifically to a rattle system that improves the sound quality of a cajon.

BACKGROUND OF THE INVENTION

Nothing about the following discussion is to be interpreted as an admission of prior art.

A cajon is well known as prior art. A cajon is a musical instrument that originated in South America. The original cajons were made out of discarded shipping crates by slaves. Subsequently, they come in all shapes and sizes.

The most common form of the cajon is a wooden box built to various sizes that is played with the performer sitting on it. The front panel or face of a cajon is most commonly wood ply, roughly ⅛" to ¼" in thickness, where the outer surface area is struck by the hand of the cajon player to achieve an audible effect. The front panel is normally mounted to the body using screws, except for the upper corners. Generally, the upper corners of the box are sanded down & tapered back creating a small gap between the front panel and the cajon body. This allows for the player to strike either upper corner causing the front panel to slap against the body causing a considerably higher pitched tonal response than any other area of the cajon. Generally, there is a hole or multiple holes, of various sizes on the cajon body itself to allow for relief of air flow resulting from the cajon being struck by the player, and to serve to amplify the sound coming from within the cajon. Any shape, such as a square cut out or portal opening can be used to achieve a similar effect.

With the cajon being an integral instrument in Flaminco and more recently in various other musical styles, the need for a better sounding cajon becomes more aparent, thus, sound quality becomes a central issue. Attempts to improve sound quality have been made in the prior art. U.S. Ser. No. 7,485,790 discloses a cajon with wires attached to the inside wherein each wire acts as a damping element. U.S. Ser. No. 7,482,522 further adds a pedal and snare carpet to change the tone of the instrument.

The prior art cajons require wires, guitar strings, or a snare carpet to be mounted up against the inside front panel. This creates certain problems. In the case where guitar string(s) are used, tuning or tension adjusting becomes an issue, thus the mounting of them becomes awkward and complicated. Multiple strings not being in tune with each other produce undesirable tones. Where a snare carpet is used, overall sound quality and complexity in design are an issue. Solutions to these problems have been long sought but prior developments have not taught or suggested any solutions and, thus, solutions to these problems have long eluded those skilled in the art.

BRIEF SUMMARY OF THE INVENTION

With the generic cajon as a starting point, the present invention is based on the intent of improving the sound quality and musicality of the cajon.

Briefly, the present invention comprises a cajon with a rattle system attached. The rattle system gives off audible sound upon inpact off the cajon.

The rattle system is an assembly of parts that include a hollow body filled with anything that emits audible noise, then sealed shut, thus the terminology rattle system, rattle assembly, or rattle body will be used at various descriptive points.

In one embodiment of the invention, the enclosed rattle assembly is filled with glass beads to enhance the audible effect or rattle.

The rattle system is designed to improve the quality (musicality) of sound, simplicity in design, and cost effectiveness to manufacture.

The end result of the sound emitted from a cajon using this approach becomes more desirable to the ear as a result of a gated effect caused because of the configuration, design characteristics, and parts used to make up the rattle system.

DETAILED DESCRIPTION OF THE INVENTION

Figure 1:
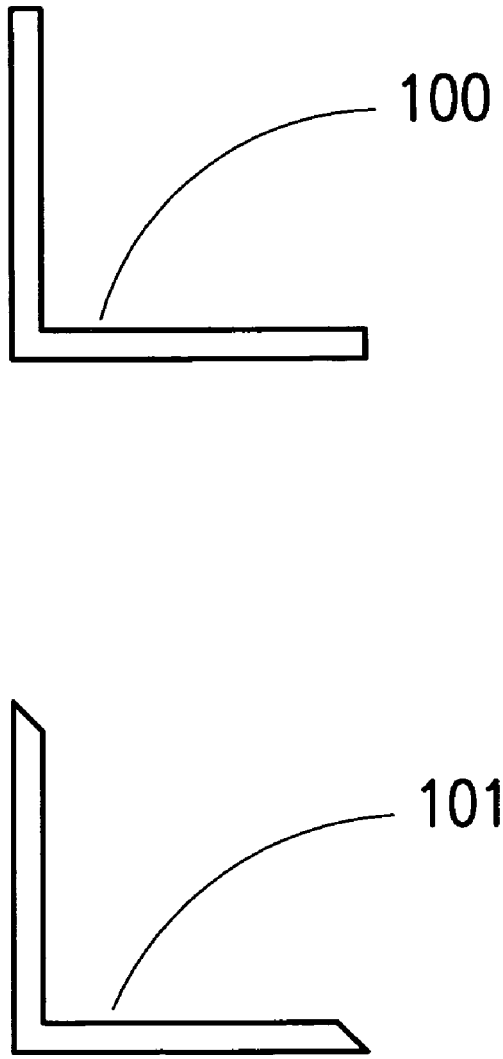
FIG. 1 shows an end view of the rattle body 101. Prior to achieving this shape, triangle pieces are cut or sanded away from rattle body 101, shown as part 100 to obtain part 101.
Figure 2:
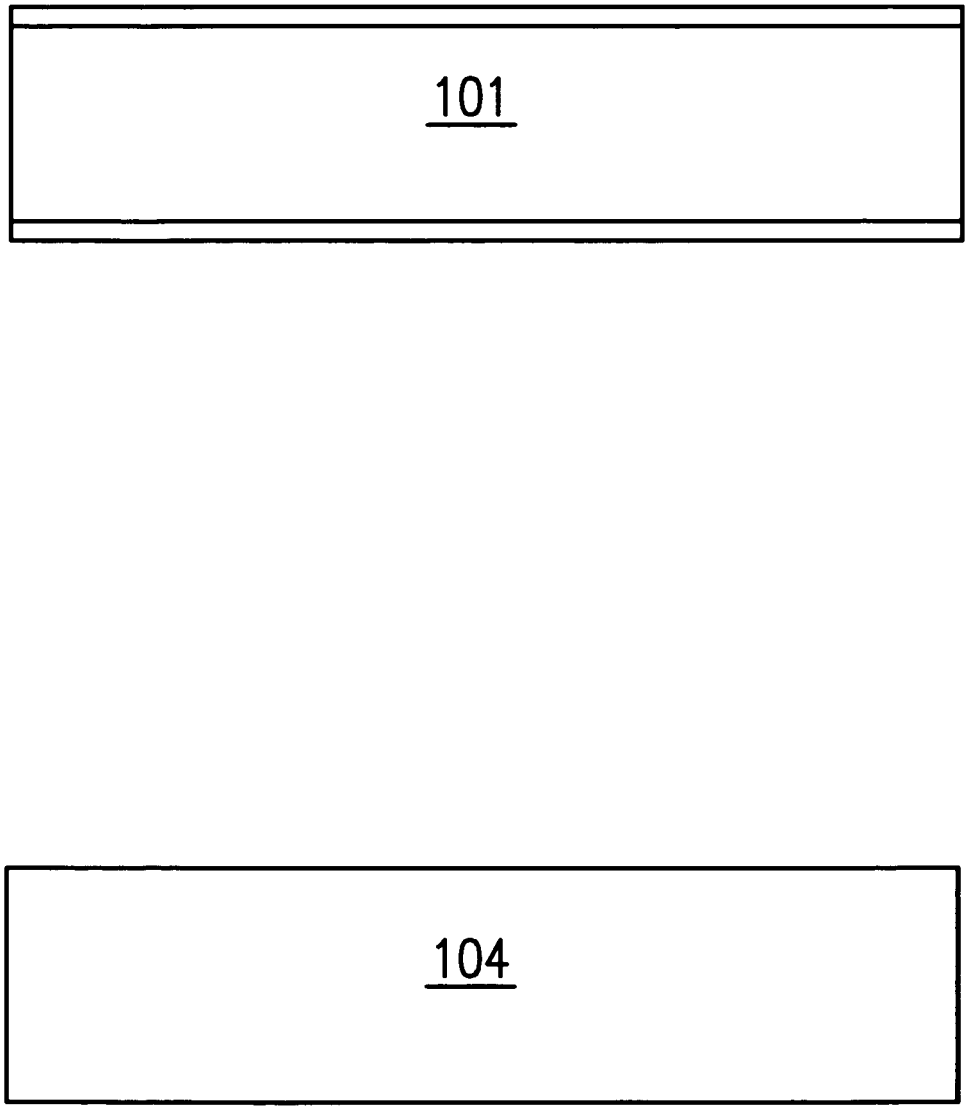
FIG. 2 shows a side view of part 101 and alternate part 104 in length.
Figure 3:
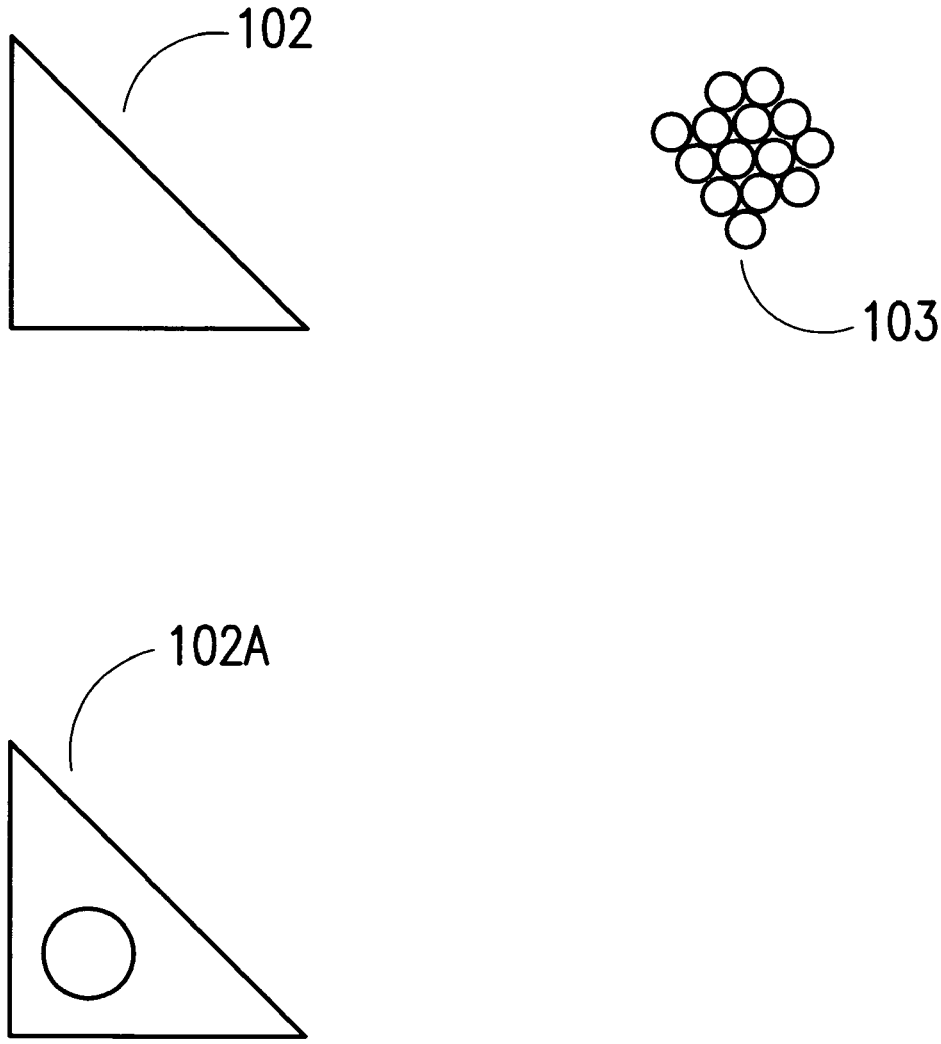
FIG. 3 shows end cap, part 102, alternate part 102A and glass beads, part 103.
Figure 4:
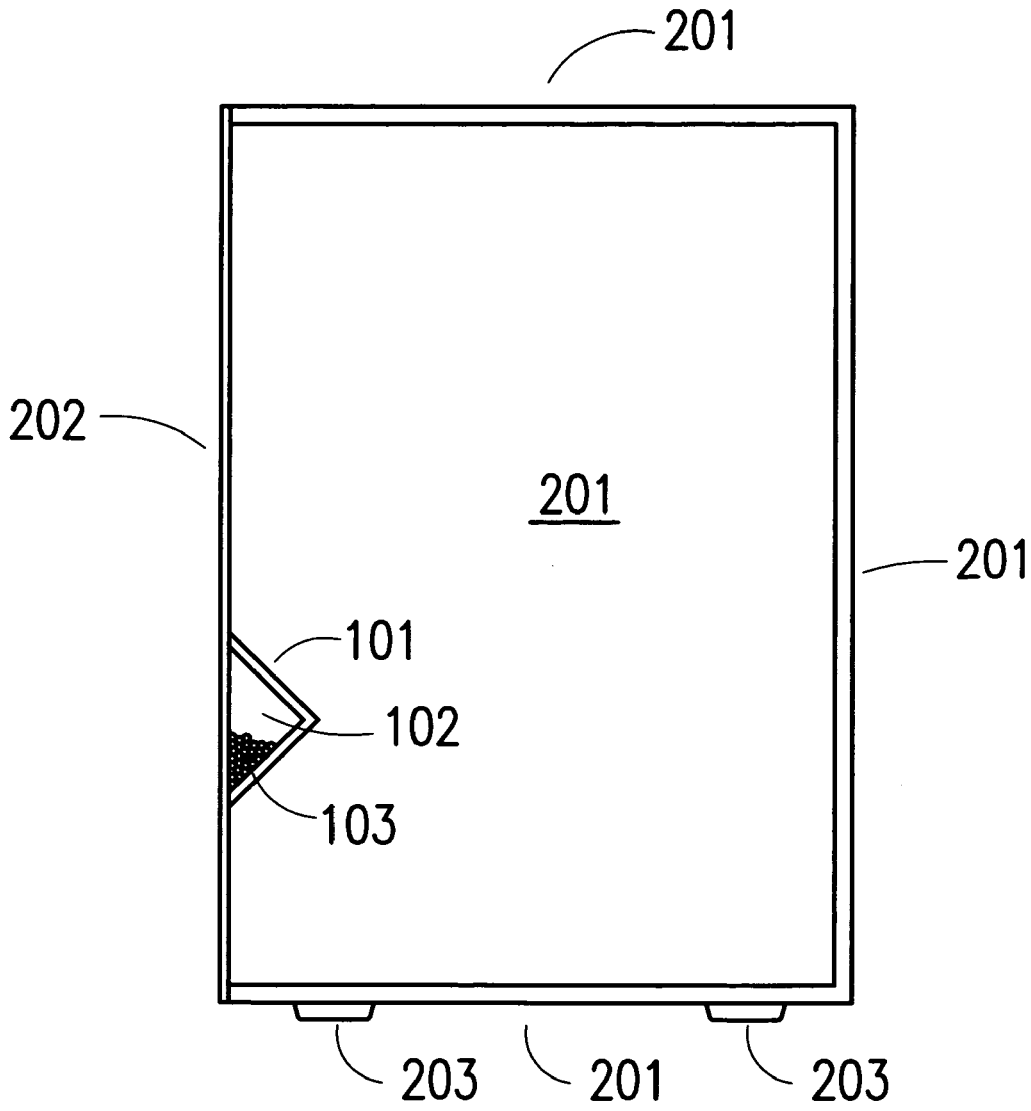
FIG. 4 shows a cross section of the cajon body 201, front panel 202, and feet 203 with the rattle system attached incorporating the rattle body, 101, end cap, 102, and glass beads, 103.
Figure 5:
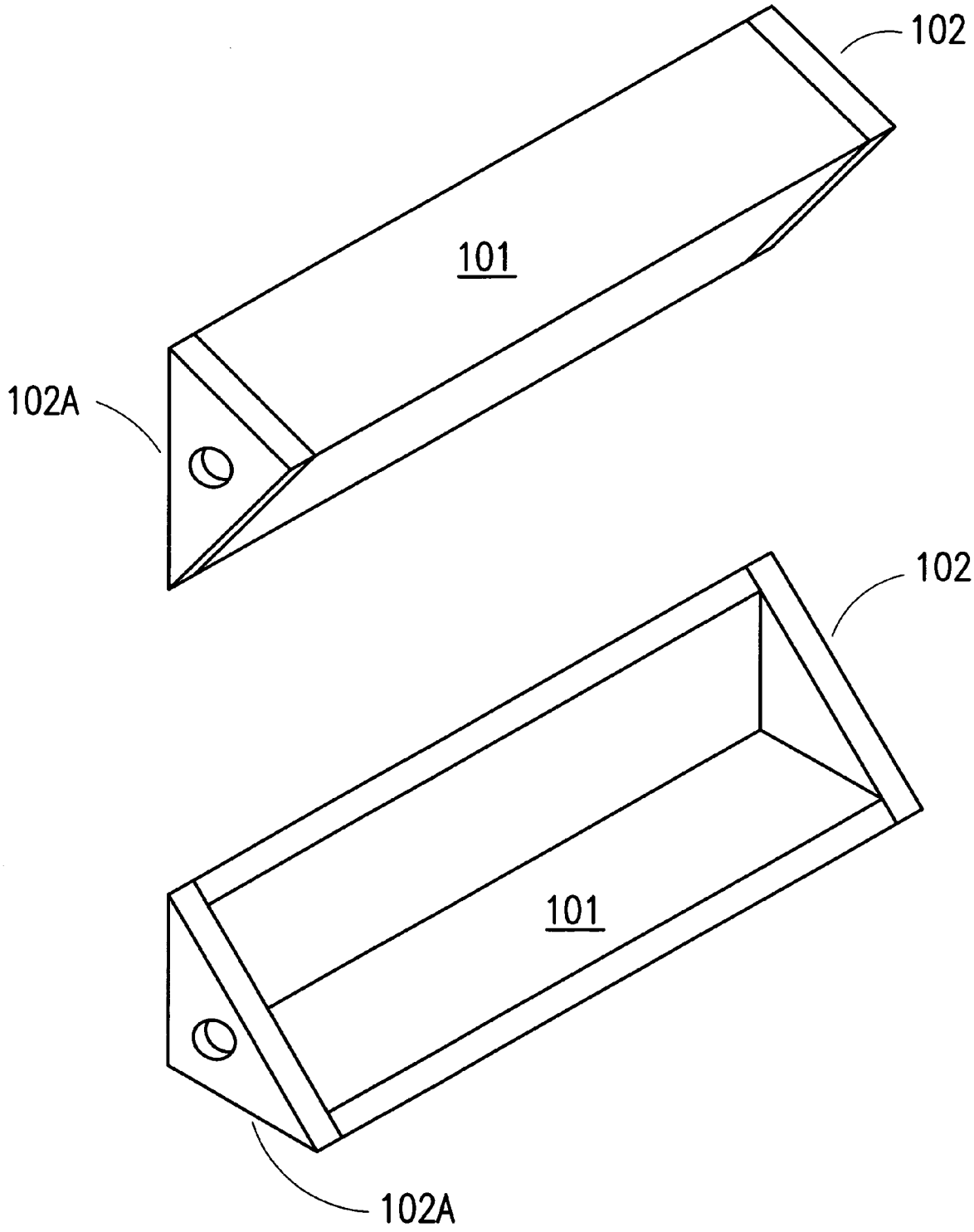
FIG. 5 shows an isometric opposite view perspective of rattle body 101 with end caps 102 and alternate part 102A attached.
Figure 6:
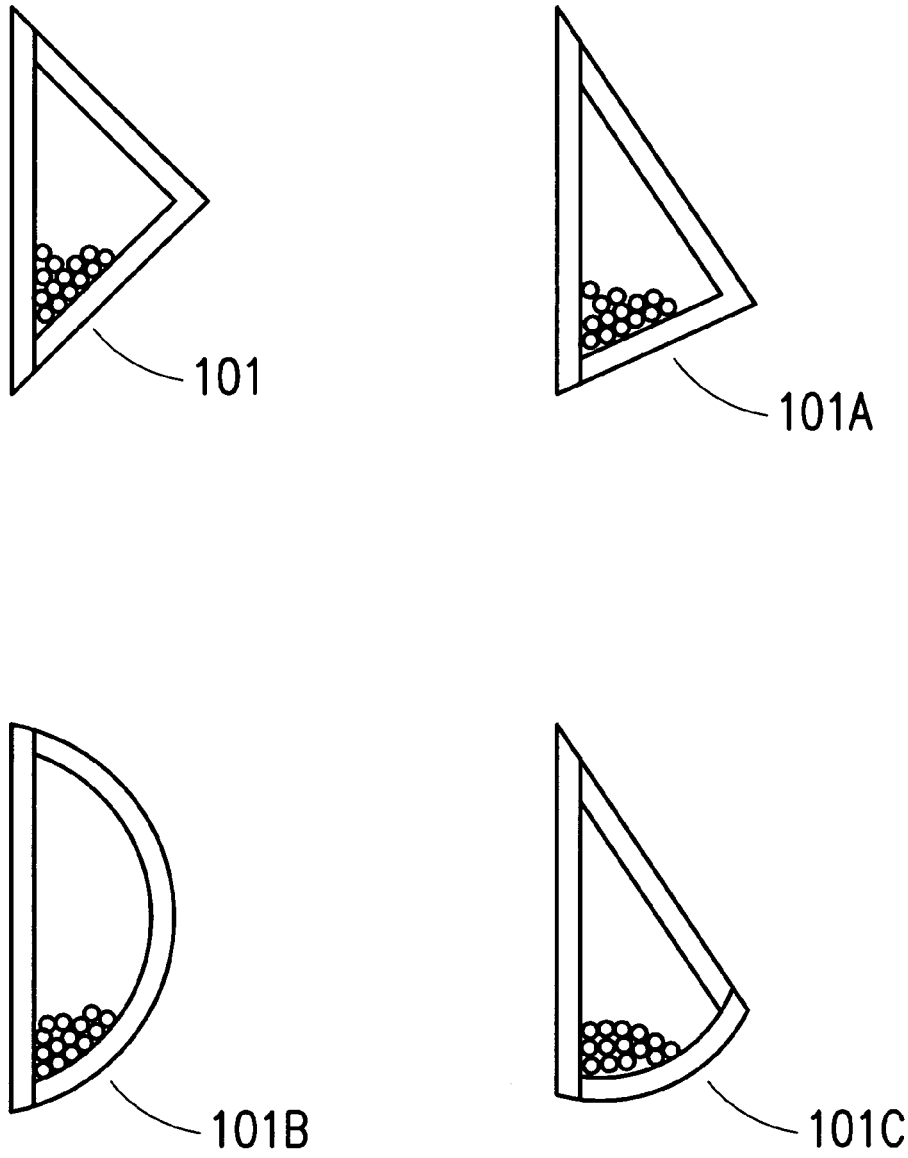
FIG. 6 shows a cross section of part 101 and different shape variations of part 101 as they relate to the rattle assembly, i.e. assemblies 101A, 101B, and 101C.
Figure 7:
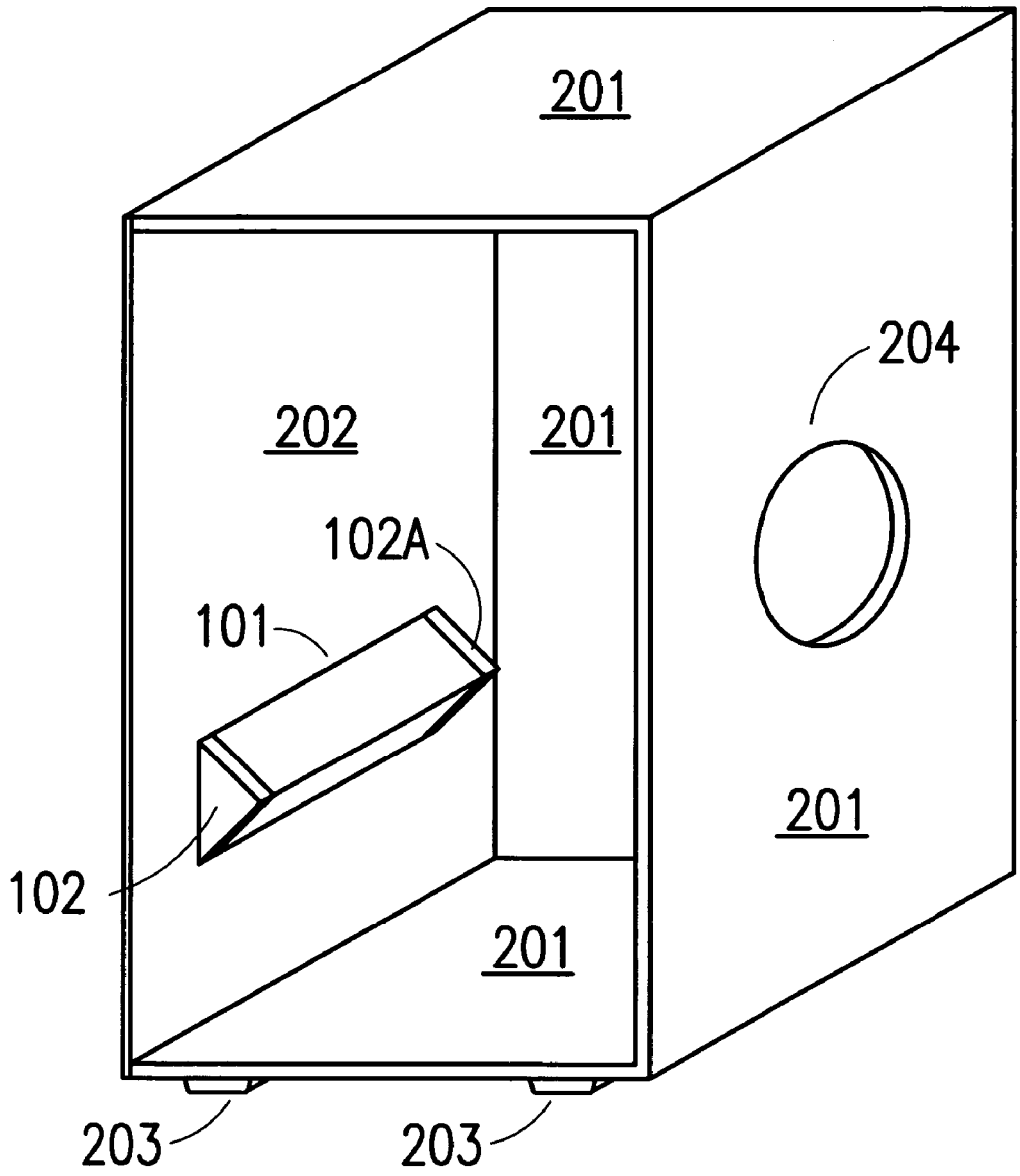
FIG. 7 shows an isometric view with one side of cajon body 201 removed to show front panel 202 attched, legs 203, and relief hole 204, incorporating rattle body 101, end cap 102 and alternate end cap 102A. Glass beads 103 do not show in this perspective as they would be sealed withing the rattle assembly.

This rattle system is designed to completely replace the use of a conventional guitar string(s), wires, or snare carpet assembly in the construction of a cajon 201. The end result of replacing the guitar string (s) or snare carpet will be the creation of an improved "type of" (more desirable, more musical) rattling or buzzing sound because of the nature of the construction and parts used that make up the rattle assembly.

The rattle system or rattle assembly consists of a piece of wood that is cut into the shape of an angle bracket, approximately 1/16" of an inch in thickness, and approximately 3/4" in height and depth on both relatively equal sized surfaces that comprise a 90 degree, "L" shaped part 101. The length or thickness of part 101 is not limited to any size and can vary to easily fit inside of cajon 201. Although the rattle assembly can be mounted in any position or at any angle within cajon 201, it is preferable to be mounted or attached in a horizontal position to the inside of front panel 202, approximately one quarter to one third of the way up from the bottom of cajon 201, to allow for the best movement, audible response and performance of the rattle system. As was previously described, the upper slap corners of the cajon give off a higher pitched and considerably different sound then on any other part of its body upon impact, therefore, it is NOT advisable to attach a rattle system to either upper slap corner of front face 202, as this would compromise the integrity of the cajon. The sound response given off by the upper corners upon impact is clear and concise and should remain as is.

With the front panel, part 202 of a typical cajon 201, detached and laying face down on a table, the rattle body 101, is placed atop its backside in the position where part 101 is pointing up, resembling the letter "A". Placing part 101 in such a fashion creates an open cavity that one can visibly see through. The rattle body 101 can then be attached to front face 202 by the simple use of glue. Rattle body 101 is then sanded down at the points that attach to part 202 to allow more surface area for the glue. Once part 101 is glued to part 202, a triangle shaped end cap, part 102 can be glued to each end to completely enclose part 101, thus leaving a hollow void within. Prior to gluing the second end cap 102 and creating said hollow void, glass beads, part 103, which come in various sizes, can be inserted inside the rattle body and permanently sealed within once the second end cap 102 is glued to body 101. The amount of glass beads, part 103, to be placed within the rattle assembly can range from one (1), to any number that can physically fit within the rattle body, keeping in mind the need for enough open space within, for the glass beads to freely move about, thus creating the prior mentioned audible enhancement. Although it is preferable Part 103 consist of glass beads, anything for that matter, small enough to fit in the rattle body (small pebbles or bee bees as an example) can be used.

Once the front panel 202 is mounted back onto the body of cajon 201, as its stands in its normal playing position, the front panel 202 can be struck by hand creating the final desired audible effect. In actuality, as the face of the front panel 202 is struck by the player, the glass beads travel up an incline of approximately 45 degrees, then return back down to their relative starting positions, thus creating a better rattle or buzzing sound with a desirable gated effect. A gated effect is described as the audible sound produced that immediately follows the impact of front panel 202, then ceases abruptly with no lingering rattle or buzzing sound. The total number of rattle assemblies is not limited to one per cajon, as multiple assemblies can be mounted anywhere inside the body to achieve additional rattling by sticking the sides, back or top of the cajon 201.

An alternate method of the assembly of the rattle system can be achieved by attaching a backing, part 104, of the same material in size and approximate thickness to fit and connect to part 101 in lieu of attaching part 101 to the front panel 202. Following the attachment of backing 104, end caps 102, and the insertion of glass beads 103, within part 101, the rattle system now becomes its own separate unit apart from front panel 202. At this point, the rattle assembly essentially becomes a self enclosed, elongated triangle shaped shaker. However, it can still be attached to front panel 202, but made to be detachable from front panel 202 by different mounting methods. This affords the cajon player the versatility to totally remove rattle system from cajon 201, but gives the option of reattaching the rattle system to cajon 201 if so desired. The end result leaves cajon 201 with or without a rattle system depending on the needs of the player.

An additional alternate method of regulating the amount rattle emitted from the rattle body can be obtained by drilling a hole in the center of end cap 102 larger than the diameter of glass beads 103. We shall refer to this part as end cap **102*a*. Once attached to the rattle system as previously described, glass beads 103 can be added to or removed from the rattle body to control the amount of audible sound given off by the rattle assembly. The hole in end cap 102*a* can then be plugged to seal off the assembly. This same concept can apply to part 101** by drilling a hole in it and repeating the prior mentioned step.

What is claimed is:

1. A cajon comprising a six sided box, having four vertical sides, a top, and a bottom, one of the vertical sides being a generally rectangular front panel having two vertical edges, a bottom generally horizontal edge and a top generally horizontal edge defining four corners, the panel is securely attached to the box along the edges except adjacent the top two upper corners that remain unattached, and a rattle device comprising a hollow, bead filled, elongated structure having at least one flat face, said rattle securely attached to the front panel inner surface at a location spaced from each of said corners and each of said edges.

2. The cajon of claim 1 wherein said box sides are formed from wood.

3. The cajon of claim 1 wherein said rattle is attached to said front panel approximately equidistantly from said corners.

4. The cajon of claim 1 wherein said rattle is attached to said front panel approximately equidistantly from all edges.

5. The cajon of claim 1 wherein said rattle has a triangular cross-section.

6. The cajon of claim 5 wherein said rattle elongated dimension is less than one-half of the dimension of the box horizontal edges.

7. The cajon of claim 6 wherein one face of said rattle is attached to the front face.

8. The cajon of claim 7 wherein said rattle has a closable opening at one end for the insertion and removal of beads.

9. The cajon of claim 1 wherein the rear panel of said box includes an opening.

10. The cajon of claim 1 wherein said front panel has a thickness that is at least less than one-fourth of the thickness of other box sides.

11. The cajon of claim 1 wherein said rattle is fabricated from wood.

12. The cajon of claim 4 wherein said rattle has a cross-section that includes one straight line such that the elongated structure includes a flat attachment face.

13. A wooden cajon in the shape of a flat-sided generally rectangular box on which a musician may be seated to play the box so as to emit drum like sounds, one side of the box defining a playing panel, said panel being relatively thin compared to the other sides, said playing panel having two vertical edges and bottom and top edges, said playing panel attached to the other sides of the box along the edges except for the upper two corners of the panel that remain loose, and a rattle device centrally mounted on said panel.

14. The cajon of claim 13 wherein said rattle device is hollow and filled with beads.

15. The cajon of claim 14 wherein said rattle device is mounted spaced from said corners and said vertical, bottom and top edges.

16. The cajon of claim 15 wherein said rattle device is mounted spaced equidistantly from said vertical edges of said panel.

17. The cajon of claim 16 wherein said rattle device is mounted spaced spaced equidistantly from said top and bottom edges of said panel.

* * * * *